US005997055A

United States Patent [19]

Strathmann

[11] Patent Number: 5,997,055

[45] Date of Patent: Dec. 7, 1999

[54] POWER-ACTUATED MOTOR-VEHICLE DOOR LATCH

[75] Inventor: Michael Strathmann, Velbert, Germany

[73] Assignee: Kiekert AG, Heiligenhaus, Germany

[21] Appl. No.: 09/281,180

[22] Filed: Mar. 30, 1999

Related U.S. Application Data

[63] Continuation-in-part of application No. 08/834,608, Apr. 14, 1997.

[30] Foreign Application Priority Data

Apr. 20, 1996 [DE] Germany ..... 196 15 764

[51] Int. Cl.[6] ..... E05C 3/06

[52] U.S. Cl. ..... 292/201; 292/199; 292/DIG. 27; 292/DIG. 62; 70/279; 70/264

[58] Field of Search ..... 292/201, 216, 292/DIG. 27, 336.3, DIG. 23, 341.16, 199, DIG. 62; 70/264, 279.1, 283, 191

[56] References Cited

U.S. PATENT DOCUMENTS

| | | | |
|---|---|---|---|
| 3,566,703 | 3/1971 | Van Noord | 292/201 |
| 4,793,640 | 12/1988 | Stewart, Sr. | 292/201 |
| 4,904,006 | 2/1990 | Hayakawa et al. | 292/201 X |
| 5,373,752 | 12/1994 | Schlagwein | 292/DIG. 43 X |
| 5,537,848 | 7/1996 | Grzanka et al. | 70/283 |
| 5,615,564 | 4/1997 | Inoue | 292/201 X |
| 5,634,676 | 6/1997 | Feder | 70/264 |
| 5,676,003 | 10/1997 | Ursel et al. | 70/264 |
| 5,722,272 | 3/1998 | Bridgeman et al. | 70/264 |

*Primary Examiner*—Darnell M. Boucher
*Attorney, Agent, or Firm*—Herbert Dubno; Andrew Wilford

[57] ABSTRACT

A motor-vehicle door latch has a latching element movable between a latched position retaining a door bolt and an unlatched position releasing the door bolt, and a locking pawl engageable with the element and displaceable between a locked position retaining the latching element and an unlocked position freeing the element. A planetary-gear drive has a reversible electric motor, a sun gear rotatable by the motor, a planet carrier, at least one planet gear meshing with the sun gear and carried on the carrier, and a ring gear meshing with the planet gear. A locking lever is displaceable by a locking element and by the planet carrier between a locked position and an unlocked position and a coupling element is displaceable between a coupling position engaged between the locking pawl and locking lever for coupling the locking pawl and lever together. An antitheft element is displaceable by the ring gear between an antitheft-on position engageable with the coupling element and retaining same in the uncoupling position and an antitheft-off position. Structure coupled to the antitheft element arrests the planet carrier in the antitheft-on position of the antitheft element. A releasable coupling is provided between the antitheft element and the ring gear for joint movement of the antitheft element and ring gear. The locking lever coupled to the antitheft element displaces of the antitheft element from the antitheft-on position to the antitheft-off position by the locking lever when the locking lever is actuated with sufficient force to release the coupling.

9 Claims, 9 Drawing Sheets

POWER-ACTUATED MOTOR-VEHICLE DOOR LATCH

CROSS REFERENCE TO RELATED APPLICATION

This application is a continuation-in-part of copending application Ser. No. 08/834,608 filed Apr. 4, 1997.

FIELD OF THE INVENTION

The present invention relates to a motor-vehicle door latch. More particularly this invention concerns such a latch that can be remotely power actuated and that has an antitheft feature.

BACKGROUND OF THE INVENTION

A motor-vehicle door latch according to commonly owned U.S. Pat. No. 5,474,338 has a housing, a latching element movable in the housing between a latched position retaining a door bolt and an unlatched position releasing the door bolt, and a locking pawl engageable in the housing with the element and displaceable between a locked position retaining the latching element in the latched position and an unlocked position allowing the latching element to move into the unlatched position. Power actuation is effected by a planetary-gear drive in the housing centered on an axis and including a reversible electric motor, a sun gear rotatable by the motor about the axis, at least one planet gear meshing with the sun gear and orbitable about the axis, a planet carrier rotatable about the axis and carrying the planet gear, and a ring gear meshing with the planet gear and rotatable about the axis. A locking lever is displaceable in the housing by a locking element—a lock button or lock cylinder—and by the planet carrier between a locked position and an unlocked position and a coupling element is displaceable in the housing between a coupling position engaged between the locking pawl and locking lever for coupling the locking pawl and lever together for joint movement from the unlocked to the locked position and a uncoupling position permitting the locking lever to move between its position without moving the locking pawl. An antitheft element is displaceable in the housing by the sun gear between an antitheft-on position engageable with the coupling element and retaining same in the uncoupling position and an antitheft-off position permitting the coupling element to move between its positions. Structure in the housing coupled to the antitheft element arrests the planet carrier in the antitheft-on position of the antitheft element.

The problem with this system is that in the event of a power failure or some problem with the central-lock system, it is possible for the latch to be left in the antitheft-on position. In this case the latch is very difficult to open.

OBJECTS OF THE INVENTION

It is therefore an object of the present invention to provide an improved motor-vehicle door latch.

Another object is the provision of such an improved motor-vehicle door latch which overcomes the above-given disadvantages, that is which can be unlatched relatively easily if power fails while it is in the antitheft-on position.

SUMMARY OF THE INVENTION

The instant invention is an improvement on a motor-vehicle door latch having a housing, a latching element movable in the housing between a latched position retaining a door bolt and an unlatched position releasing the door bolt, and a locking pawl engageable in the housing with the element and displaceable between a locked position retaining the latching element in the latched position and an unlocked position allowing the latching element to move into the unlatched position. A planetary-gear drive in the housing centered on an axis includes a reversible electric motor, a sun gear rotatable by the motor about the axis, a planet carrier rotatable about the axis, at least one planet gear meshing with the sun gear, carried on the carrier, and orbitable about the axis, and a ring gear meshing with the planet gear and rotatable about the axis. A locking lever is displaceable in the housing by a locking element and by the planet carrier between a locked position and an unlocked position and a coupling element is displaceable in the housing between a coupling position engaged between the locking pawl and locking lever for coupling the locking pawl and lever together for joint movement from the unlocked to the locked position and a uncoupling position permitting the locking lever to move between its position without moving the locking pawl. An antitheft element is displaceable in the housing by the ring gear between an antitheft-on position engageable with the coupling element and retaining same in the uncoupling position and an antitheft-off position permitting the coupling element to move between its positions. Structure in the housing coupled to the antitheft element arrests the planet carrier in the antitheft-on position of the antitheft element. According to the invention a releasable coupling is provided between the antitheft element and the ring gear for joint movement of the antitheft element and ring gear. The locking lever is coupled to the antitheft element for displacement of the antitheft element from the antitheft-on position to the antitheft-off position by the locking lever when the locking lever is actuated with sufficient force to release the coupling.

The invention is based on the recognition that in a door latch of this type it is relatively easy to replace the solid connection between the antitheft element and the planetary-gear drive with a coupling that releases if stressed beyond a certain limit. The coupling is sufficient to transmit all the forces during normal operation of the lock, but when in an emergency substantially more force can be applied to release the coupling and operate the latch manually. This is typically done by means of the outside locking element, typically a key cylinder.

The structure according to the invention includes a sector gear rotatable about a sector-gear axis, meshing with the ring gear, and carrying the antitheft element. This sector gear further has a lobe projecting radially of the sector-gear axis and a recess is formed on the planet gear that is complementary to the lobe. The lobe is engageable in the recess to arrest the planet carrier when the antitheft element and sector gear are in the antitheft position. The coupling between the antitheft element and the locking lever includes an elastically radially interfitting groove and ridge formation between the antitheft element and the sector gear. More specifically the antitheft element has a shaft extending along the sector-gear axis and formed with the groove formation and the sector is formed with the ridge formation. The sector gear is formed adjacent the ridge formation with a slot permitting radial elastic deflection of the ridge formation. This sector gear is made of a limitedly elastically deformable plastic.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
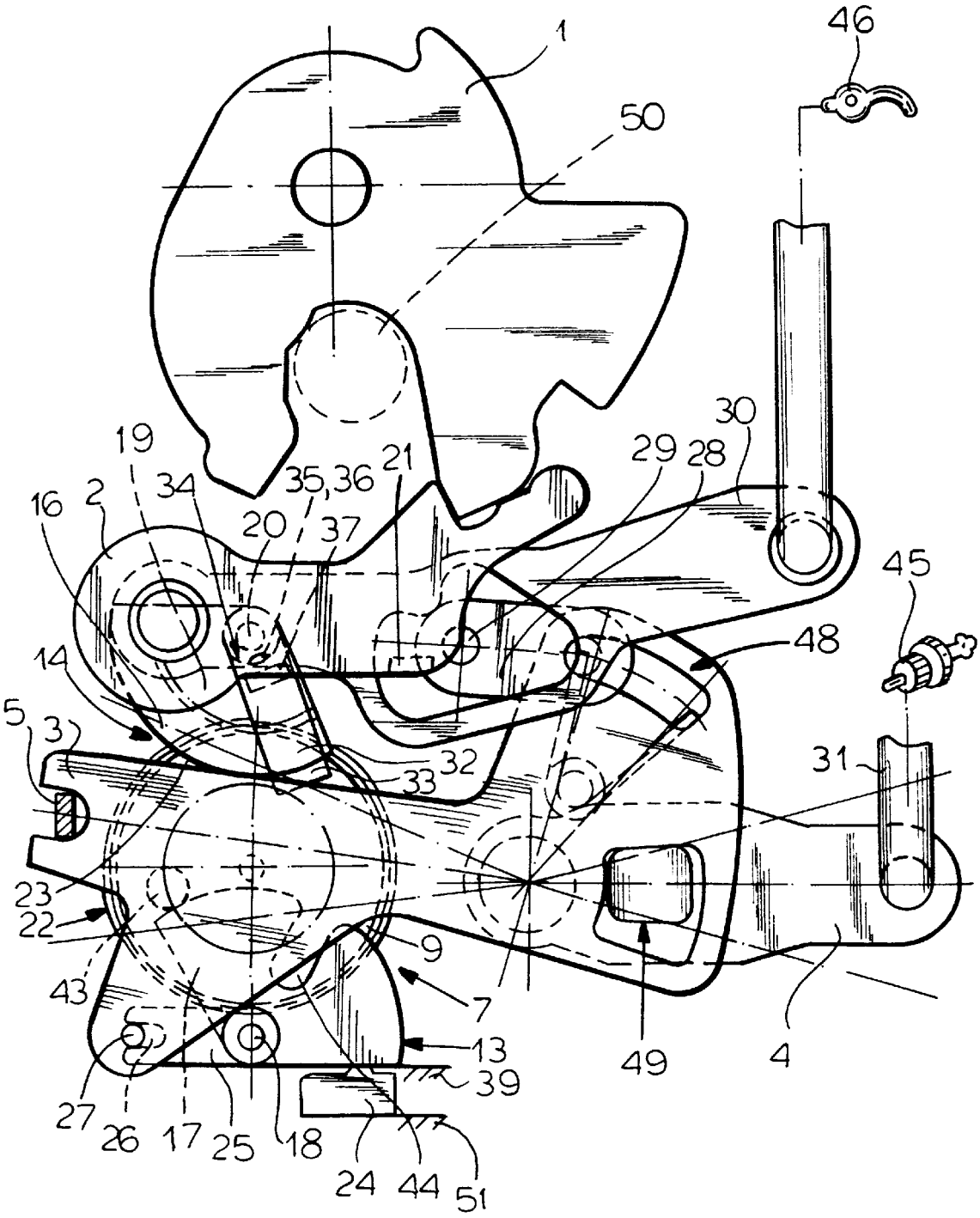
FIG. 1 is a side partly sectional view of the latch according to the invention in the locked and antitheft-off positions.
Figure 13:
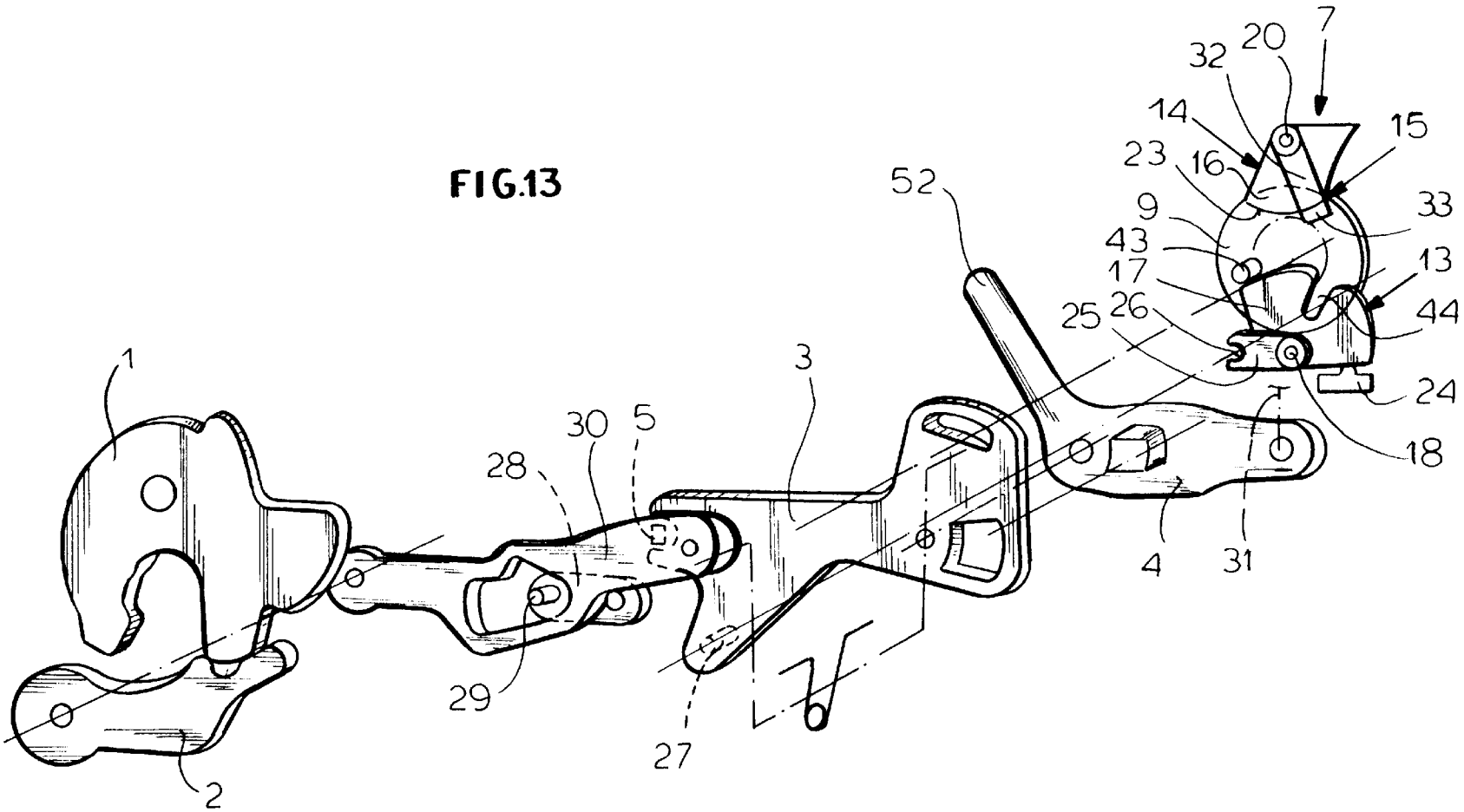
FIG. 13 is an exploded view of the basic elements of the latch according to the invention.

As seen in FIGS. 1 and 13 a motor-vehicle door latch according to the invention has a bolt 50 that is mounted on a door post and that can be captured by a latch fork 1 pivoted on a latch housing 51 on the edge of a door and retainable in the illustrated latched position by a conventional latch pawl 2 in the manner well known in the art. Pivoting of the pawl 2 about its axis clockwise will free the fork 1 to unlatch the door and allow it to be opened. An actuating lever 30 secured on the same pivot as the pawl 2 can be operated by an inside or outside door handle, such as illustrated at 46, to operate the latch. A coupling pin 29 described in more detail below can engage in an unlocked position (see 29" in FIG. 6) of the door between a stepped edge of the lever 30 and a tab 21 on the pawl 2 so that clockwise pivoting of the lever 30 is transmitted to the pawl 2 to unlatch the door. When the pin 29 is pulled to the right as seen in FIG. 1 and at 29' in FIG. 6 into a locked position where it no longer couples the lever 30 and pawl 2 together, downward pivoting of the actuating lever 30 will not unlatch the door. This structure is all generally standard.

Figure 2:
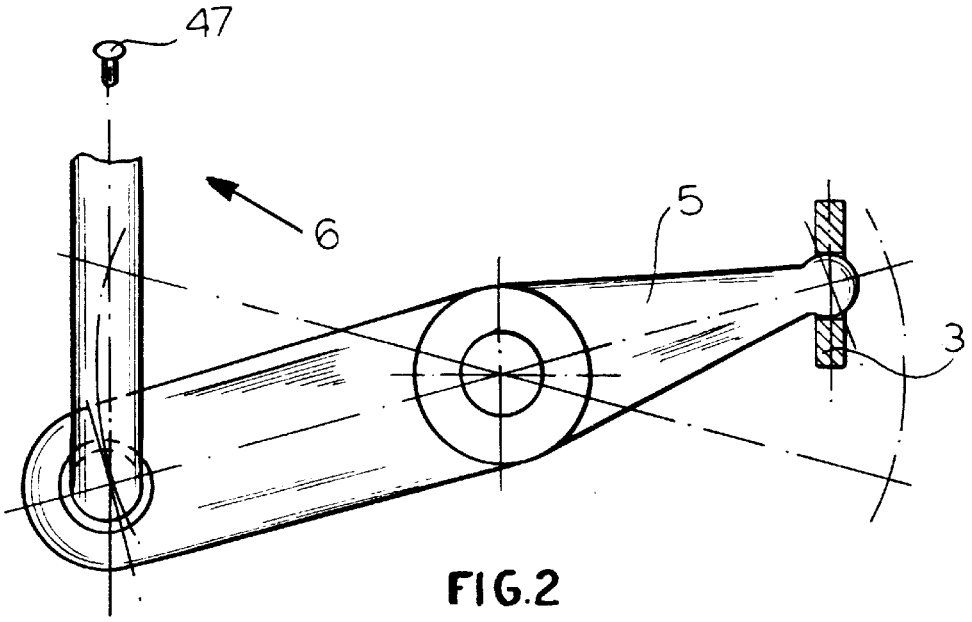
FIG. 2 is a large-scale view of a detail of FIG. 1 taken in a plane perpendicular to the view of FIG. 1.

A main locking lever 3 pivoted about an axis parallel to the axes of the fork 1 and pawl 2 carries via a lost-motion coupling 48 a link 28 carrying the pin 29. This lever 3 can be pivoted about its axis by an outside locking lever 4 coupled to it via another lost-motion coupling 49. The lever 4 is connected via a rod 31 to an outside locking element, here a key cylinder 45. An inside locking element or button 47 shown in FIG. 2 is coupled via a rod 6 and a lever 5 to the main locking lever 3. Thus depression of the rod 6 by the button 47 or raising of the rod 31 by the cylinder 45 will pivot the main lever 3 counterclockwise from the position illustrated in FIG. 1 and put the pin 29 into its position 29" to couple the actuating lever 30 to the pawl 2, allowing the lever 30 to unlatch the door by movement of the pin 29 into the position shown at 29'" in FIG. 6. Either of the locking elements 45 or 47 can, however, pivot the lever 3 clockwise into the illustrated locked position in which the coupling pin 29 uncouples the lever 30 from the pawl 2.

Figure 4:
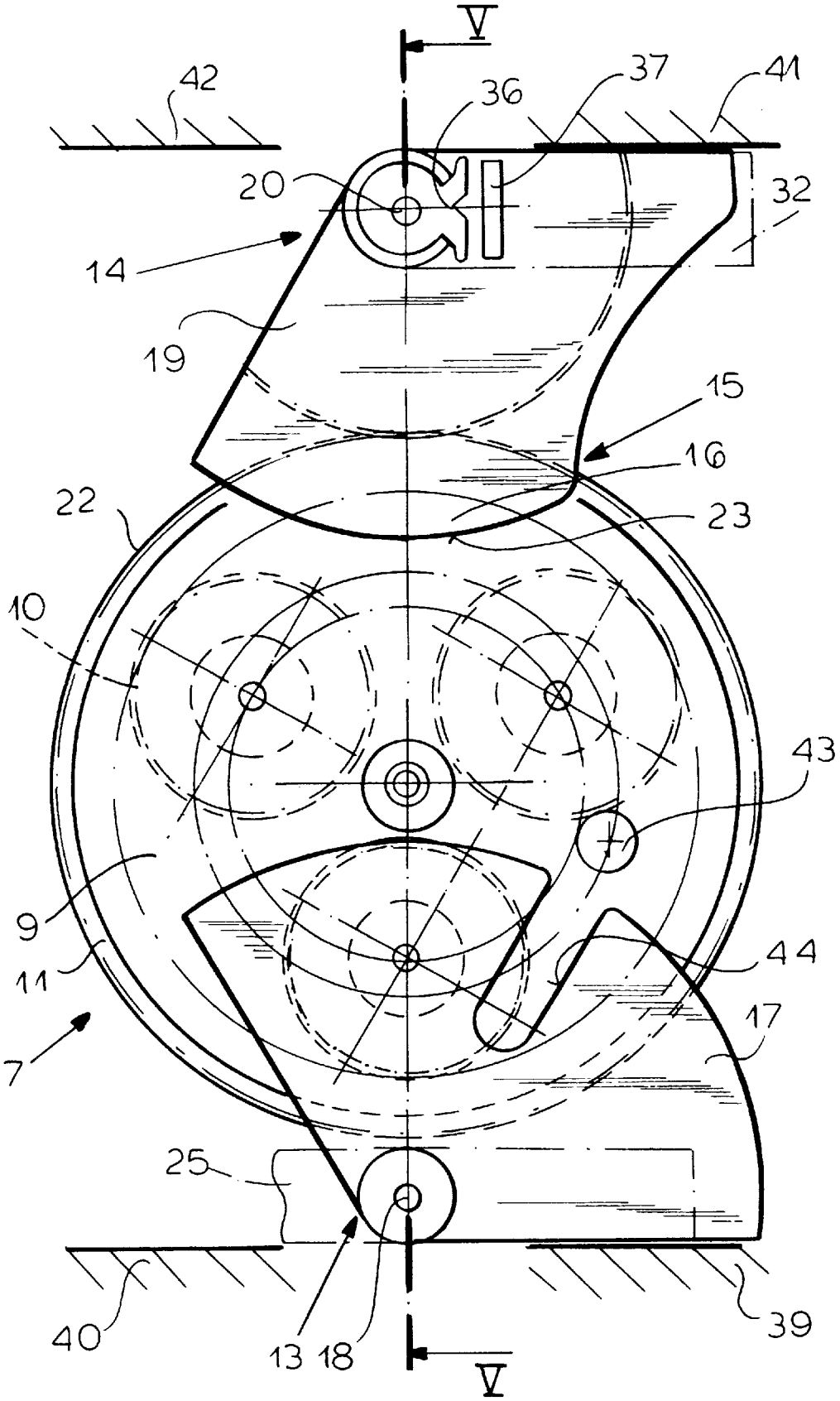
FIG. 4 is a partly diagrammatic large-scale view of a detail of FIG. 1 in the locked and antitheft-on positions.
Figure 5:
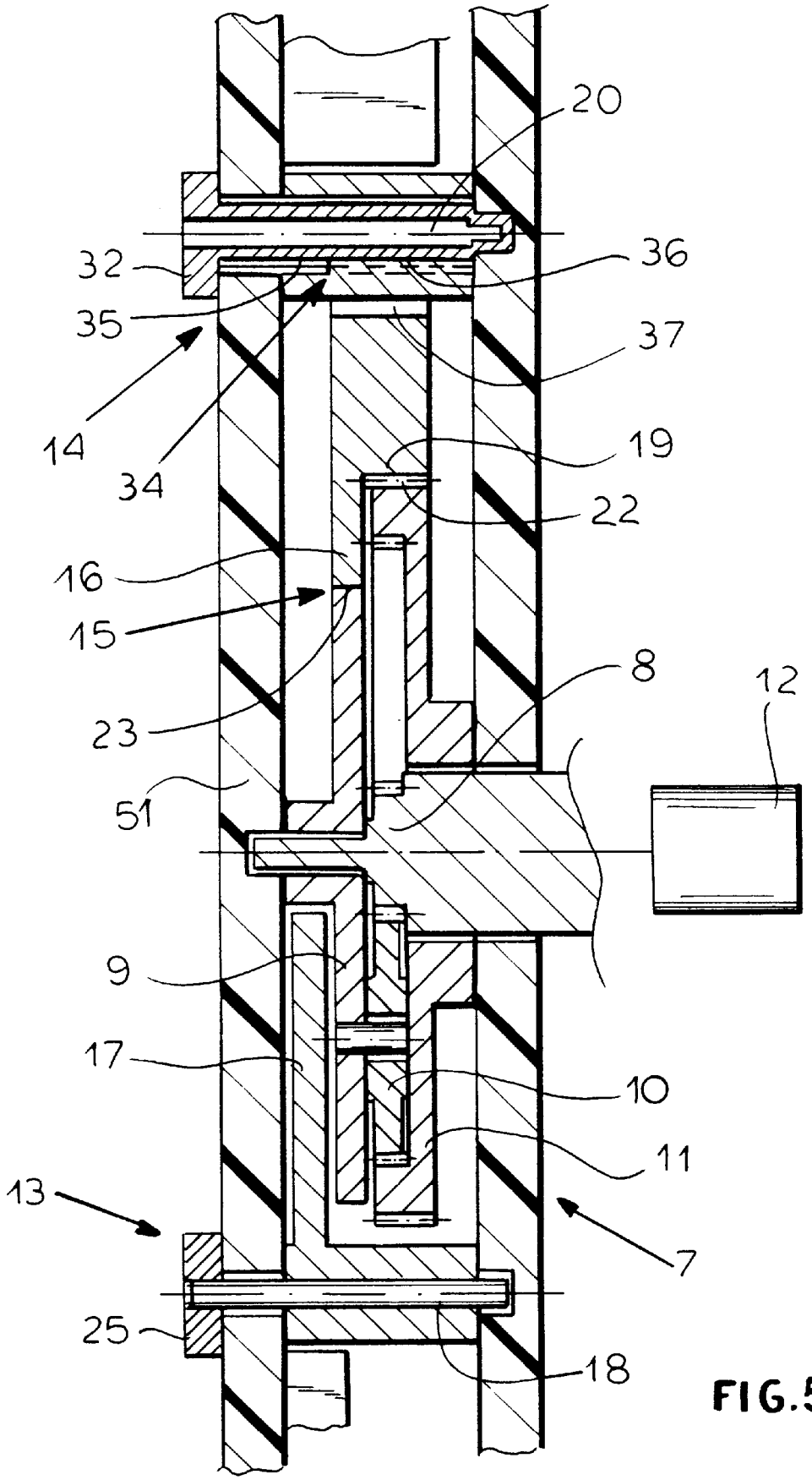
FIG. 5 is a section taken along line V—V of FIG. 4.
Figure 6:
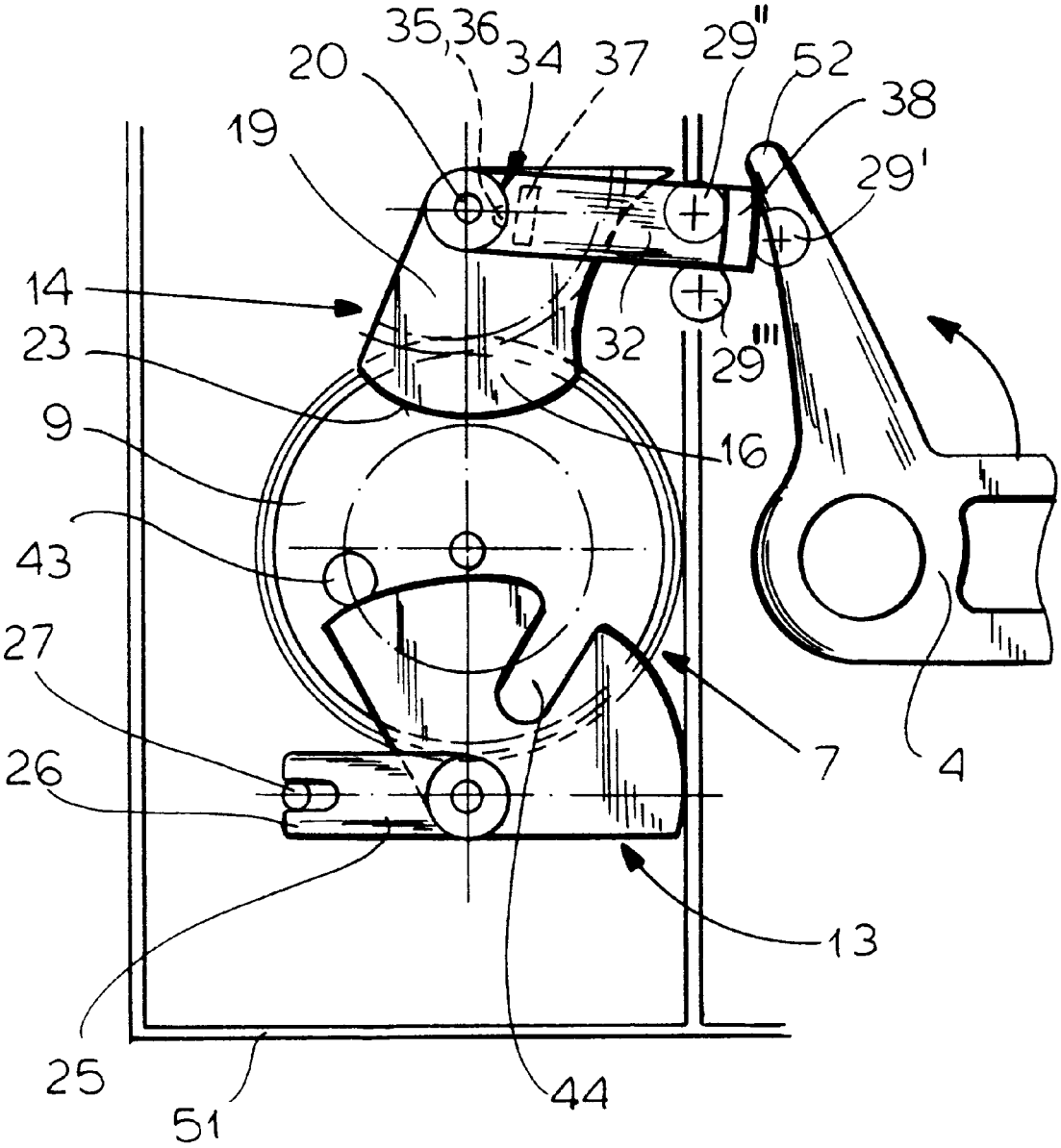
FIGS. 6 and 7 are views like FIG. 3 showing parts of the latch in different positions.

A planetary-gear power actuator 7 is provided to switch between the above-described locked and unlocked positions, and also to set the latch in an antitheft position in which the latch cannot be unlocked even using the element 45 or 47. This actuator 7 has as best seen in FIGS. 4 through 6 a sun gear 8 meshing with three planet gears 10 supported on a rotatable planet carrier 9 and also meshing with another ring gear 11. The sun gear 8 is operated by a reversible electric motor 12. The planet carrier 9 can act on a locking assembly 13 mounted on a shaft 18 and an antitheft assembly 14 mounted on a shaft 20, both these shafts 18 and 20 being parallel to each other and to an axis of the sun gear 8 and to the axes of the fork 1, pawl 2, and lever 3. The ring gear 11 can also act on the antitheft assembly 14 as described below.

Figure 3:
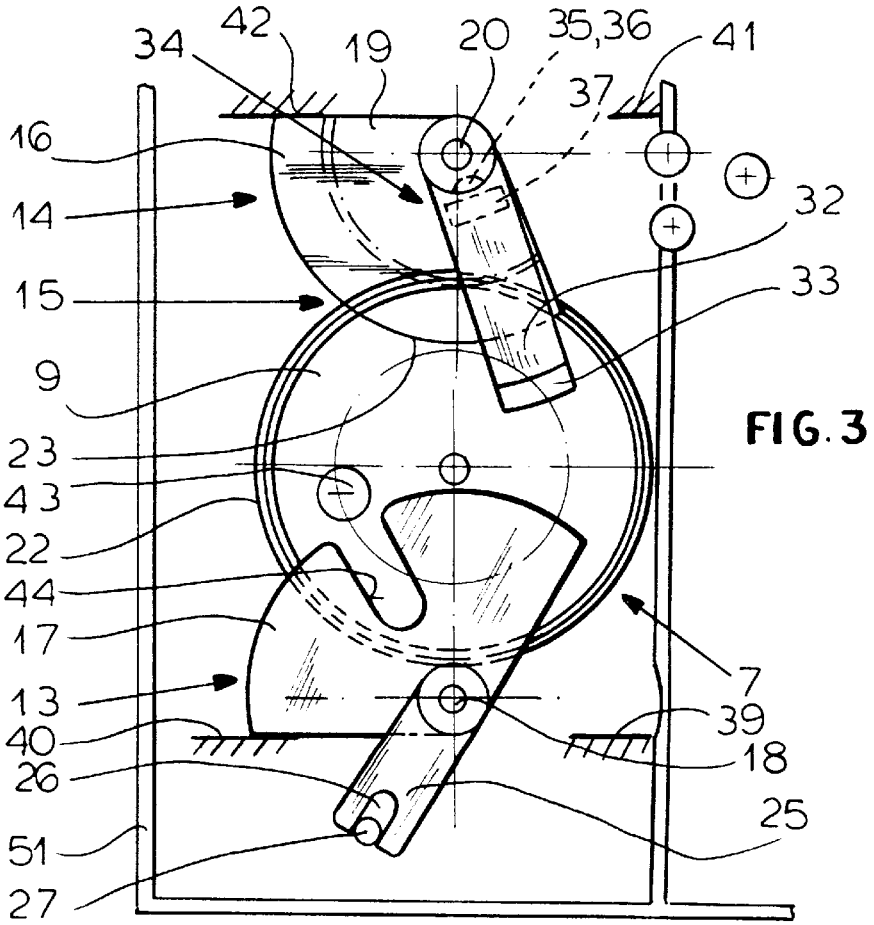
FIG. 3 is a vertical section corresponding to a detail of FIG. 1 but along a different plane and showing the system in the unlocked and antitheft-off positions.

The locking assembly 13 comprises a plate 17 fixed on the shaft 18 and formed with a radially open slot 44 that a pin 43 on the carrier 9 can engage in. This plate 17 can pivot through about 60° between a locked position (FIG. 4) engaging a fixed housing abutment 39 and an end switch 24 (FIG. 1) and a position (FIG. 3) engaging another fixed housing abutment 40. A lever or arm 25 fixed on the shaft 18 has a forked end 26 which engages over a pin 27 (see FIG. 1) fixed on the lever 3. Thus as the plate 17 moves between its locked and unlocked positions it pivots the lever 3 synchronously between its locked and unlocked positions. As long as the pin 43 is not engaged in the slot 44, however, the lever 3 can move independently of the plate 17.

Figure 7:
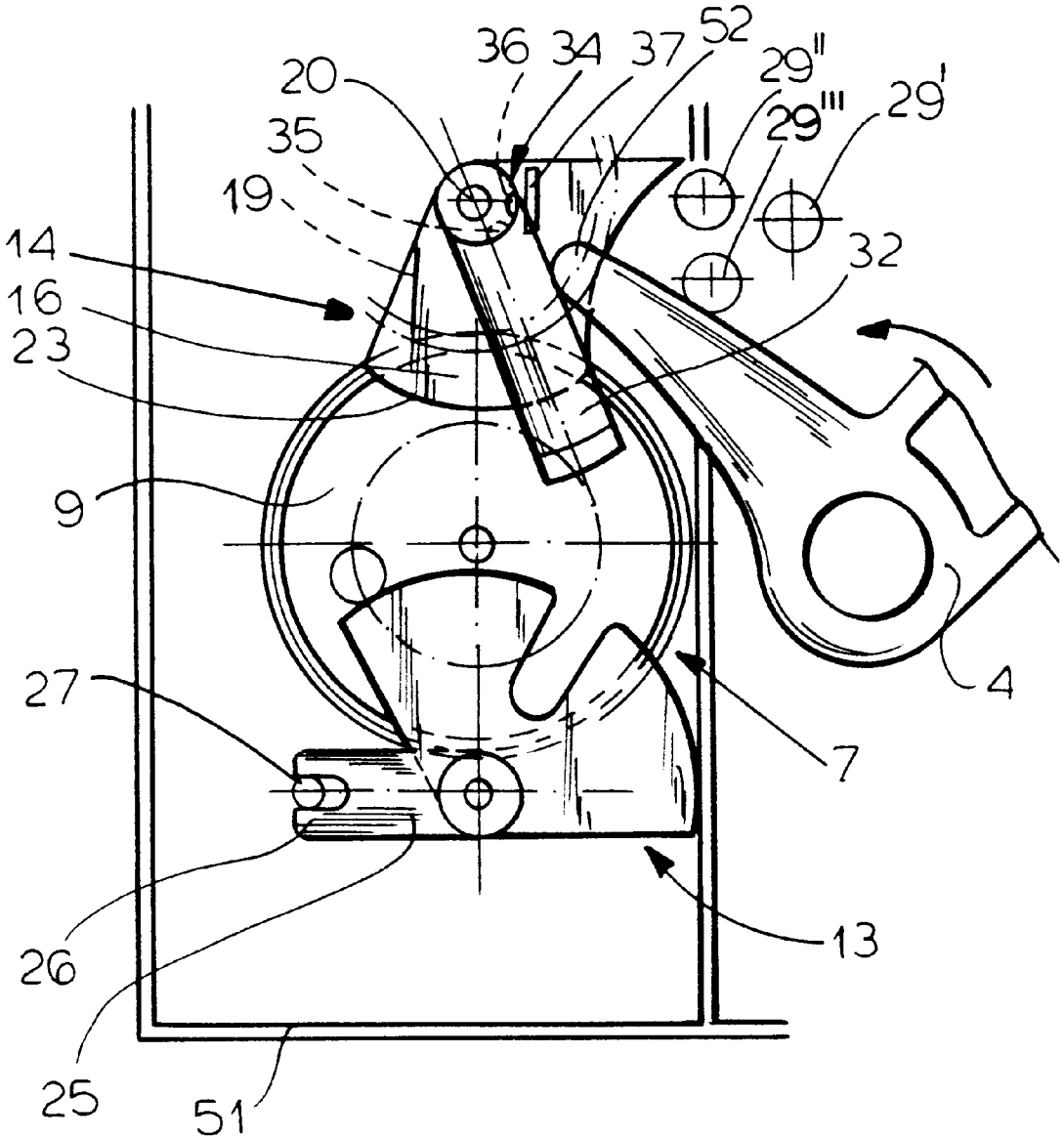
Figure 8:
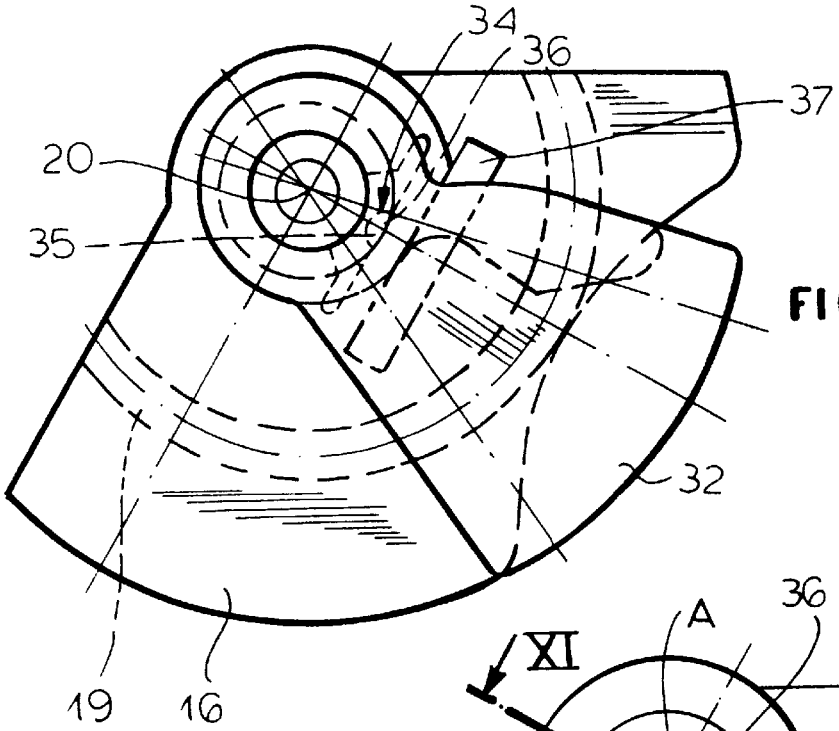
FIG. 8 is a side view of a detail of FIG. 1.
Figure 9:
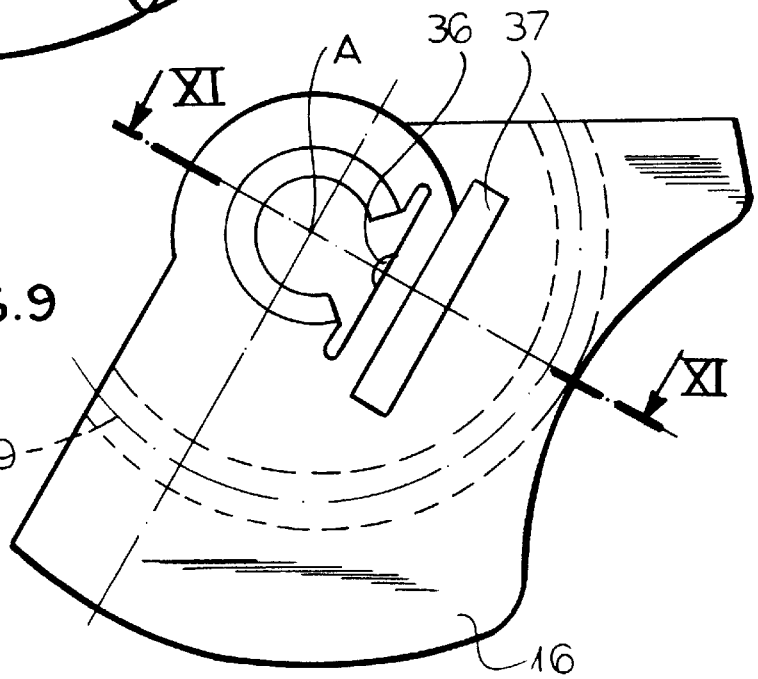
FIGS. 9 and 10 are views of details of FIG. 8.
Figure 10:
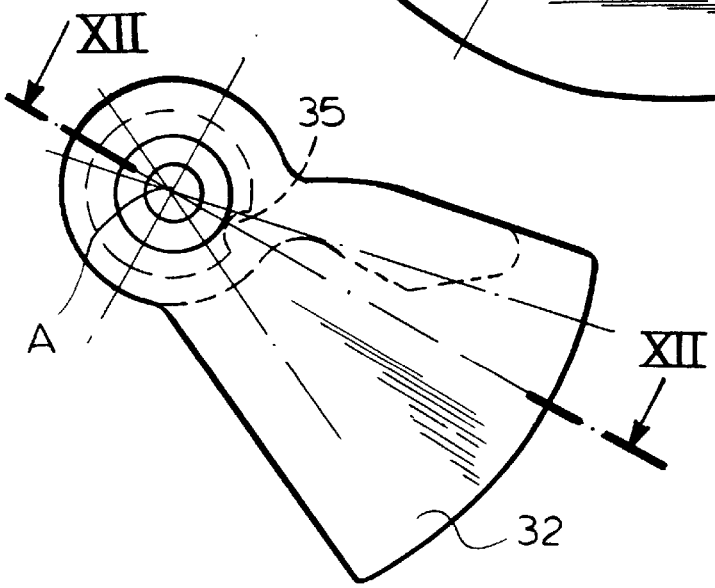
Figure 11:
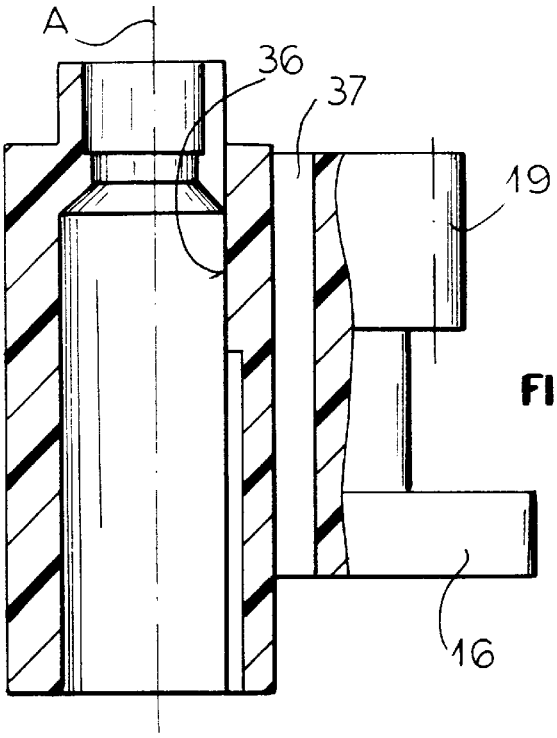
FIGS. 11 and 12 are sections taken along respective lines XI—XI and XII—XII of FIGS. 9 and 10, respectively.
Figure 12:
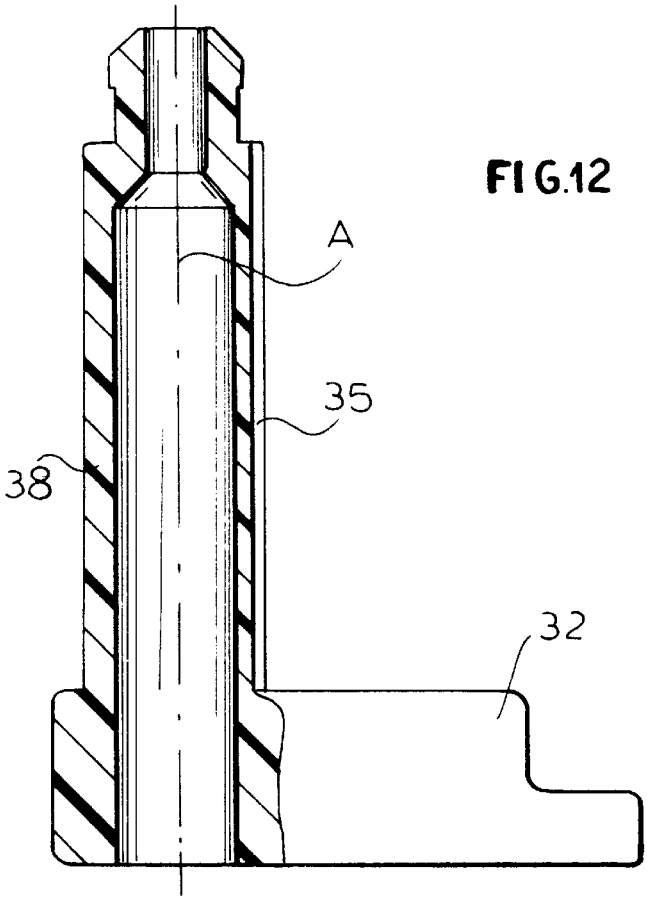

The antitheft assembly 14 comprises as shown in FIGS. 4, 6, and 7 a sector gear or plate 19 fixed on the shaft 20 and meshing with teeth 22 on the outside of the ring gear 11. This sector gear 19 has a radially projecting part-circular tongue or part 16 whose outer edge has a center of curvature on the shaft 20 and which can engage in a complementary outwardly open part-circular cutout 23 formed on the planet carrier 9. The gear 19 is movable angularly between an antitheft-on position engaging a fixed housing abutment 41 (FIG. 4) and with its part 16 engaged in the cutout 23 and an antitheft-off position (FIG. 3) engaging a fixed housing abutment 42 and with a cutout 15 engaging over the edge of the planet carrier 9. When the part 16 engages in the cutout 23, the planet carrier 9 cannot rotate but when the carrier 9 fits into the cutout 15 it can rotate. The shaft 20 carries a lever or arm 32 having a bent over end 33 that in the antitheft-on position blocks leftward movement of the pin 29 into the coupling position 29", but in the antitheft-off position permits movement of the coupling pin 29 between its coupling and uncoupling positions 29" and 29', respectively. The locking lever 4 has as shown in FIGS. 6 and 7 an arm 52 that can pivot the lever 32 for emergency operation as described below.

The latch described above operates as follows:

In the starting position of FIGS. 1 and 6 the plate 17 engages the abutment 39 and switch 24 so that it can no longer rotate clockwise. The carrier 9 and pin 43 are rotated fully counterclockwise so the pin 43 rests on the edge of the plate 17. If the motor 12 continues to rotate with the carrier 9 thus arrested, the ring gear 11 will be forced to rotate. This will pivot the antitheft plate 19 into the antitheft-on position whereupon further rotation will be impossible and a timer will cut out the motor 12. In this antitheft position, as described above, the door is locked and cannot be unlocked, even using the unlock elements 45 since the pin 29 is blocked by the end 33 and cannot move into the coupling position engageable between the tab 21 and the edge of the cutout in the lever 30.

From this position, reverse rotation of the motor 12 will to start with rotate the sun gear 11 in the opposite direction, at first therefore moving the arm 32 from the antitheft-on to the antitheft-off position. In this latter position the tongue 16 has moved out of the cutout 23, freeing the carrier 9 to rotate so that it will turn, engaging the pin 43 in the slot 44 and moving the latch to the unlocked position and, in fact, pulling the pin 43 out of the slot 44 to permit manual actuation of the latch. This action therefore moves the mechanism into the unlocked position in which actuation of the lever 30 will unlatch the door because the coupling pin 29 will be positioned between the tab 21 and the edge of the cutout in the lever 30 to couple the lever 30 to the pawl 2.

Of course during either operation the motor 12 can stop intermediately in the locked/antitheft-off position. In the locked and unlocked positions manual operation of the latch is permitted as shown in FIGS. 6 through 12. In addition emergency operation is possible via the outside locking element 45 since the extension arm 52 of the lever 4 can act directly on the arm 32 and push it down, allowing the door to be unlocked and unlatched.

According to the invention the arm 32 is not permanently coupled to the antitheft gear 19 but instead as illustrated in FIGS. 6 and 7, can be pivoted relative to the plate 19. This is necessary to allow an emergency unlocking of the door when the latch is in the antitheft position, as for example when power fails.

To this end a resilient coupling 34 is provided between the arm 32 and the gear 19. It is constituted as shown in FIGS. 8 through 12 by a groove 35 extending axially along a tubular stem 38 extending along an axis A of the shaft 20. This stem 38 fits in a bore of the gear 19 and this gear 19 is formed with a radially inwardly projecting ridge or bump 36 that can engage in the groove 35. A tangential slot 37 cut in the gear 16 behind the bump 36 allows it to be deflected radially of the axis A.

Thus it is possible when the system is in the antitheft position, with the gear 19 engaging the abutment 41, for actuation of a key in the lock 45 to forcibly move the lever 32 with the lever 4 independently of the gear 19. In this manner even if, for example, the vehicle's battery fails with the latch in the antitheft position, one can unlock the door manually using the key cylinder 45.

I claim:

1. In a motor-vehicle door latch having:

a housing;

a latching element movable in the housing between a latched position adapted to retain a door bolt and an unlatched position adapted to release the door bolt;

a locking pawl engageable in the housing with the latching element and displaceable between a locked position retaining the latching element in the latched position and an unlocked position allowing the latching element to move into the unlatched position;

a planetary-gear drive in the housing centered on an axis and including a reversible electric motor, a sun gear rotatable by the motor about the axis, a planet carrier rotatable about the axis, at least one planet gear meshing with the sun gear, carried on the carrier, and orbitable about the axis, and a ring gear meshing with the planet gear and rotatable about the axis;

a locking lever displaceable in the housing by a locking element and by the planet carrier between a locked position and an unlocked position;

an actuating lever pivotal on the housing;

means including a coupling element displaceable in the housing between a coupling position engaged between the locking pawl and locking lever for coupling the locking pawl and actuating lever together for movement of the pawl from the unlocked to the locked position and an uncoupling position permitting the actuating lever to move without moving the locking pawl;

means including an antitheft element displaceable in the housing by the ring gear between an antitheft-on position engageable with the coupling element and retaining same in the uncoupling position and an antitheft-off position permitting the coupling element to move between its positions; and means including structure in the housing coupled to the antitheft element for arresting the planet carrier in the antitheft-on position of the antitheft element, the improvement comprising means including a releasable coupling between the antitheft element and the ring gear for joint movement of the antitheft element and ring gear; and means coupling the locking lever to the antitheft element for displacement of the antitheft element from the antitheft-on position to the antitheft-off position by the locking lever when the locking lever is actuated with sufficient force to release the coupling.

2. The motor-vehicle door latch defined in claim 1, further comprising a plate pivotal about a plate axis parallel to the planetary axis, formed with a slot open radially of the plate axis, and coupled to the locking lever; and a pin on the planet carrier engageable in the slot, whereby the planet carrier is coupled to the locking lever via the pin and plate.

3. The motor-vehicle door latch defined in claim 1 wherein the structure includes:

a sector gear rotatable about a sector-gear axis, meshing with the ring gear, and carrying the antitheft element.

4. The motor-vehicle door latch defined in claim 3 wherein the sector gear further has a lobe projecting radially of the sector-gear axis, the structure further including a recess formed on the planet gear and complementary to the lobe, the lobe being engageable in the recess to arrest the planet carrier when the antitheft element and sector gear are in the antitheft-on position.

5. The motor-vehicle door latch defined in claim 3 wherein the means coupling the antitheft element to the locking lever includes an elastically radially interfitting groove and ridge formation between the antitheft element and the sector gear.

6. The motor-vehicle door latch defined in claim 5 wherein the antitheft element has a shaft extending along the sector-gear axis and formed with the groove formation and the sector gear is formed with the ridge formation.

7. The motor-vehicle door latch defined in claim 6 wherein the sector gear is formed adjacent the ridge formation with a slot permitting radial elastic deflection of the ridge formation.

8. The motor-vehicle door latch defined in claim 7 wherein the sector gear is made of a limitedly elastically deformable plastic.

9. The motor-vehicle door latch defined in claim 1 wherein the housing is provided with abutments operatively engaged by the antitheft element and locking lever in the locked, unlocked, antitheft-on, and antitheft-off positions.

* * * * *